United States Patent [19]

Cole et al.

[11] Patent Number: 4,659,325

[45] Date of Patent: Apr. 21, 1987

[54] CENTRIFUGE ROTOR HAVING A FLEXIBLE CARRIER

[75] Inventors: Paul M. Cole, Wilmington; William G. Johanson, Newark; both of Del.; Ronald F. McConnell, West Chester, Pa.; Peter Popper; William E. Velvel, both of Wilmington, Del.

[73] Assignee: E. I. Du Pont de Nemours and Company, Wilmington, Del.

[21] Appl. No.: 684,946

[22] Filed: Dec. 21, 1984

[51] Int. Cl.[4] ..... B04B 5/02

[52] U.S. Cl. ..... 494/20

[58] Field of Search ..... 494/16, 20, 17, 18; 422/72, 102

[56] References Cited

U.S. PATENT DOCUMENTS

| | | | |
|---|---|---|---|
| 263,053 | 8/1882 | McCollin . | |
| 780,315 | 1/1905 | Wetherill . | |
| 950,741 | 3/1910 | Berry | 494/20 |
| 986,130 | 3/1911 | Binford . | |
| 1,929,696 | 10/1933 | Kashiwagi . | |
| 3,456,917 | 7/1969 | Palfreyman et al. . | |
| 3,752,390 | 8/1973 | Chulay . | |
| 4,190,195 | 2/1980 | Chulay . | |
| 4,400,166 | 8/1983 | Chulay et al. . | |

*Primary Examiner*—Robert W. Jenkins

[57] ABSTRACT

A centrifuge rotor which a central hub is characterized by a flexible carrier formed from a plurality of fibers arranged in a predetermined textile structure. The carrier has a socket formed at the radially outer end thereof by the interconnection of the fibers. The socket may receive a vessel therein.

57 Claims, 23 Drawing Figures

Fig. 7
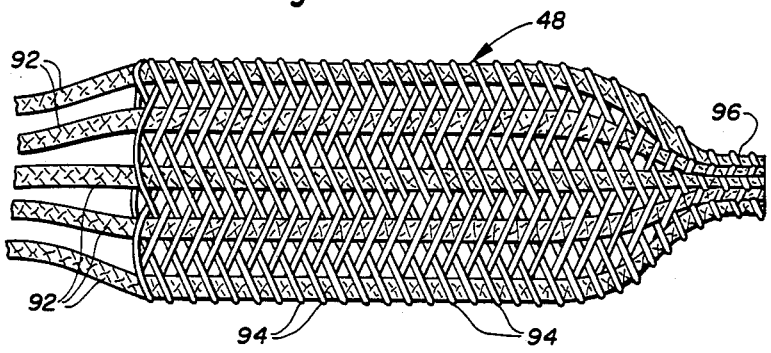
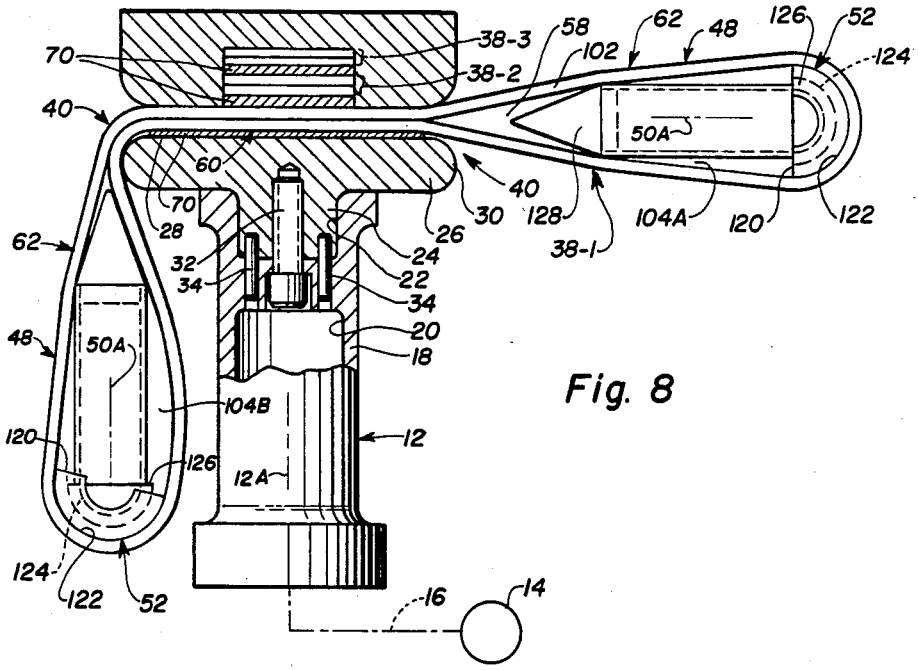
Fig. 8

176
174
172
168
172S
170
178
144S
144
168
145
142
144
142
140
180
178
146
173
66
38-1
148A
146
70
38-3
38-2
68
38-1
30
26
32
148A
34
34
12
12A
16
14

CENTRIFUGE ROTOR HAVING A FLEXIBLE CARRIER

BACKGROUND OF THE INVENTION

This invention relates to a rotor for a centrifuge and in particular to a swinging bucket centrifuge rotor which includes a flexible carrier.

CROSS REFERENCE TO RELATED APPLICATION

The subject matter disclosed and claimed herein is disclosed in the following copending application:

Restoring Cap Assembly For A Centrifuge Rotor Having A Flexible Carrier, filed in the name of Paul Morrison Cole on Dec. 21, 1984 and accorded Ser. No. 684,936.

DESCRIPTION OF THE PRIOR ART

Swinging bucket centrifuge rotors are well known in the art. Such devices are operative to expose a liquid sample disposed within a sample container to a relatively high centrifugal force field. Such rotors, when used in devices generally known as "ultracentrifuges", may be either of the fixed angle or the swinging bucket type.

With a swinging bucket-type centrifuge rotor the sample containers are supported within carriers which are oriented such that in an initial position the axis of each carrier and the sample container therein extends parallel to the axis of rotation of the centrifuge rotor. However, during rotor operation the carrier and the sample container therein pivots to an operational or working position wherein the axis of the sample container is perpendicular to the axis of rotation of the rotor.

Due to the extremely high centrifugal forces involved in ultracentrifugation, (generated by rotor speeds that are often in excess of 50,000 revolutions per minute), extreme care must be taken to provide a secure pivotal attachment for the carrier as it reciprocally pivots between the initial to the working positions. Typically such pivoting arrangements use a hanger which includes a hook-like appurtenance formed (typically integrally) with the carrier. The hanger engages rod-like trunnions suitably mounted on the rotor body. Exemplary of such pivoting arrangements are those shown in U.S. Pat. No. 3,752,390 (Chulay) and U.S. Pat. No. 4,190,195 (Chulay et al.). U.S. Pat. No. 4,400,166 (Chulay et al.) relates to a modified carrier in which the upper end thereof is provided with a transversely extending opening through which a trunnion bar extends. The bar is received at its extremities in vertically disposed guide ways provided in the body of the rotor.

One of the perceived disadvantages with the present generation of ultracentrifuge rotors of the swinging bucket type is believed to involve the complexity of the hanger attachment on which the pivotal movement of the carrier occurs. Moreover, since this point of attachment is the weakest link the swinging bucket rotor must be made necessarily bulky in order to provide the requisite support for the carriers. This bulk detracts from the rotor performance by increasing acceleration and deceleration times. It also mandates increased centrifuge rotor containment requirements and reduces accessibility to the sample container.

Accordingly, in view of the foregoing, it is believed advantageous to provide a swinging bucket centrifuge rotor which uses the flexible deformation of the material of a flexible carrier to support the sample containers and accommodate their movement from a first, rest, position to the second, operational, position which overcomes the above-discussed perceived disadvantages of the prior art.

SUMMARY OF THE INVENTION

The present invention relates to a centrifuge of the swinging bucket-type which, in its broadest aspect, comprises: a central hub connectable to a source of motive energy; and a flexible sample carrier connectable to the hub. The carrier has a bendably deformable region in the vicinity of the periphery of the hub to permit a sample container carried and supported by the carrier to move under the application of centrifugal force from a first, rest, position to a second, operational, position. The motion of the sample container is accommodated by the flexible deformation of the material of the sample carrier rather than by the pivotal motion of rigid members with respect to each other. The same material that deforms to accommodate motion of the container also accepts the tensile load imposed on the container and the carrier by centrifugal force.

In accordance with this invention the sample carrier is fabricated from a plurality of fibers arranged in a textile structure. The fibers are suitably interconnected to form at the radially outer end of the carrier at least one sling-like socket. The socket may be formed from the fibers connected to themselves with or without the use of suitable "helper" yarns and/or rigidization so as to exhibit adequate strength to resist the hydrostatic pressure developed within the liquid sample by centrifugation. In this event the socket may directly receive the sample container. Alternatively, the socket may receive a vessel able to withstand the centrifugation pressure. The vessel is sized to accept the sample container. In the event that a vessel is provided a suitable force transmission arrangement, for example, in the form of a footing or saddle, may be needed to transmit tensile loads imposed on the container and the vessel to the flexible carrier.

The fibers which form the carrier may be arranged in any textile structure, e.g., strands, braids, or weaves. In addition, the fibers of the carrier may be arranged in the form twisted or plied structures or knits. The carrier may be rigidized, as by resin impregnation, in the region of its attachment to the hub and/or at the radially outer ends. In the strand or braided embodiments the fibers are arranged so as to diverge from each other to define an opening through which access to a sample container may be afforded. In the weave embodiment the fibers are arranged in a woven strap which is laid back on itself in which access to the sample container may be obtained from between the plies of the strap.

A rotor may be assembled from a plurality of sample carriers as described above which are layered across the hub. Alternately a rotor may be formed without layering using a flexible carrier in which the plurality of sockets thereon are flexibly interconnected to define a central web region which is suitably attached to the hub.

BRIEF DESCRIPTION OF THE DRAWINGS

The invention will be more fully understood from the following detailed description thereof taken in connection with the accompanying drawings which form a part of this application and in which:

FIG. 7 is an enlarged view of the arragement of the braided structure including helper yarns which cooperate to define the socket in the carrier shown in FIGS. 5 and 6;

FIGS. 8 and 9 are views similar to FIGS. 3 and 4, respectively illustrating a centrifuge rotor having a layered stack of flexible carriers in accordance with still another embodiment of the present invention in which the textile structure of each carrier is arranged in a weave;

FIG. 18 is a side elevational view of an alternate embodiment of the restoring cap assembly used with a flexible carrier (shown in outline) in accordance with the present invention while

FIG. 20 is a side elevational view of yet another alternate embodiment of the restoring cap assembly used with a flexible carrier (shown in outline) in accordance with the present invention while

DETAILED DESCRIPTION OF THE INVENTION

Figure 1:
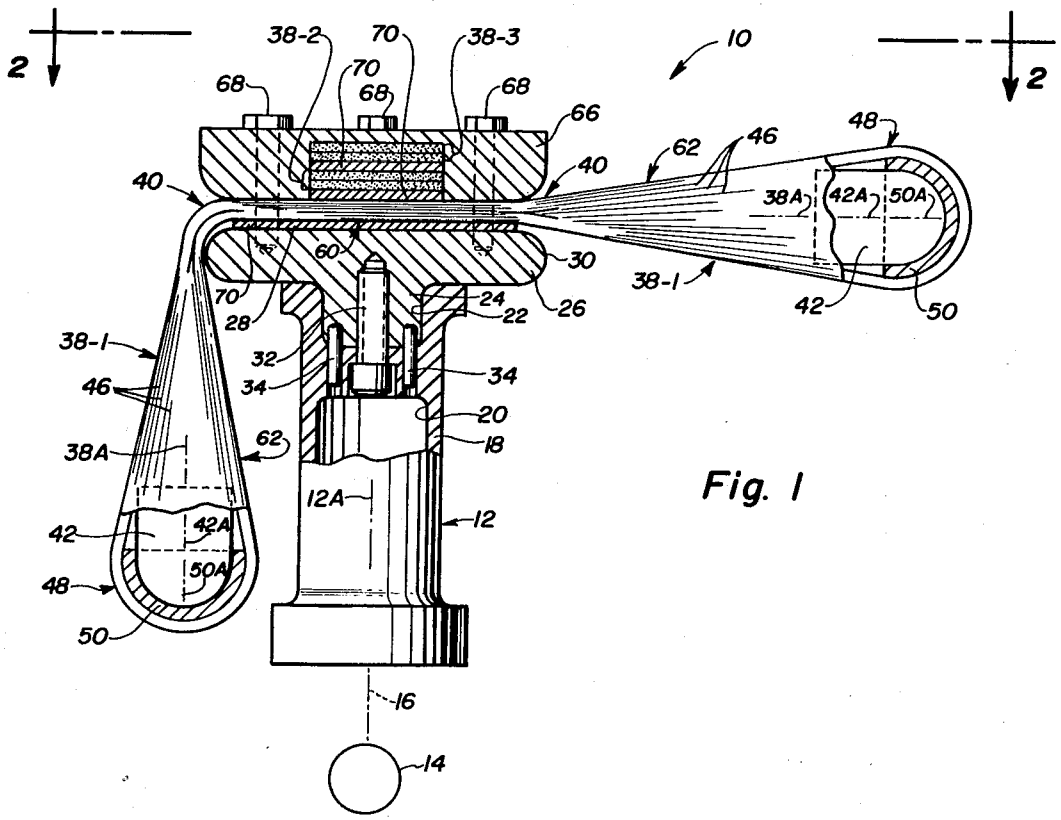
FIG. 1 is a side elevational view entirely in section of a centrifuge rotor having a layered stack of flexible carriers in accordance with one embodiment of the present invention in which the textile structure of each carrier is arranged in strands.

Throughout the following detailed description, similar reference numerals refer to similar elements in all figures of the drawings.

A swinging bucket centrifuge rotor generally indicated by reference character 10 in accordance with the the present invention includes a sample carrier generally indicated by reference character 38 which, in its broadest aspect, is formed of fibers arranged in any predetermined textile structure such that the carrier bendably deforms to accommodate motion from a first, rest, position to a second, operational, position. The rotor 10 described herein is primarily used in ultracentrifuge instruments wherein the rotational speed is in excess of 50,000 revolutions per minute, although it should be understood that its use is not limited exclusively thereto and thus may be used in any centrifuge instrument.

The centrifuge rotor 10 includes a central hub generally indicated diagrammatically by reference character 12 that is connectable (as indicated by the schematic drive connection 16) to a suitable source of motive energy such as a drive motor 14 for rotation of the hub 12 about a central vertical axis of rotation 12A. As is illustrated in FIG. 1 the hub 12 includes a pedestal 18 having a hollow 20 formed therein. A suitable drive connector (not shown) is received within the hollow 20 to interconnect the rotor 10 with the drive motor 14. The upper end of the pedestal 18 includes a recess 22 which is sized to receive the shank 24 of a substantially disk-like base member 26. The upper surface 28 of the base member 26 is substantially planar (although, as developed herein, it may be grooved) and provided with a rounded periphery, as shown at 30. The pedestal 18 and the base member 26 are securely interconnected by a press fit and secured with a threaded bolt 32. Rotative force is positively applied through the pedestal 18 to the base 26 by means of the press fit and an array of drive pins 34.

Figure 2:
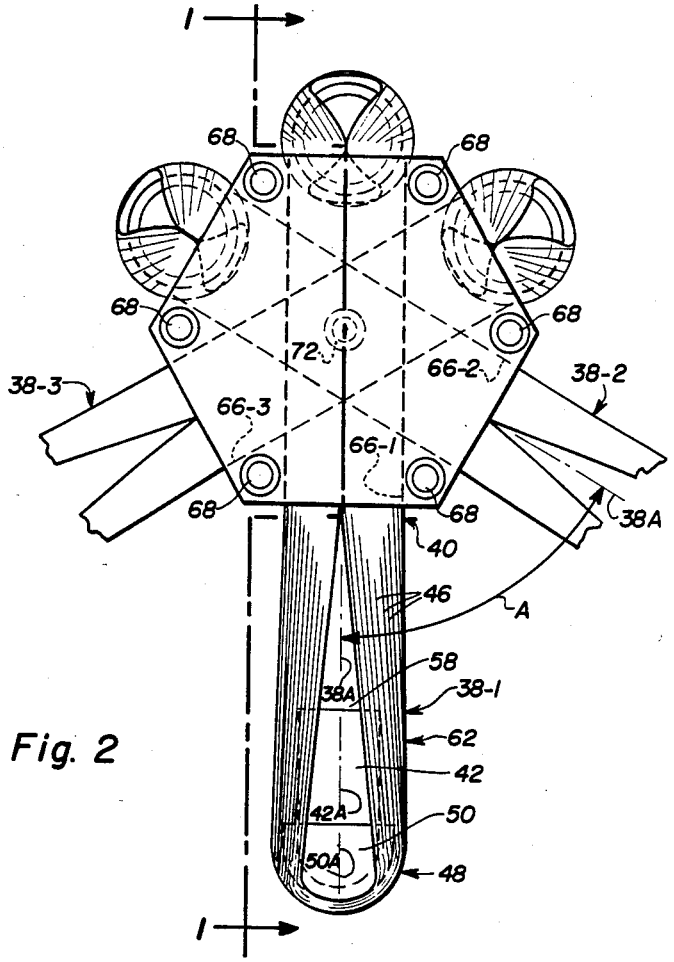
FIG. 2 is a plan view taken along view lines 2—2 of FIG. 1.

The embodiment of the flexible sample carrier 38 shown in FIGS. 1 and 2 is bendably deformable in the vicinity 40 of the periphery of the hub 12 to permit a sample container 42 carried and supported by the carrier 38 to move under the application of centrifugal force from the first, rest, position (shown in the left side of FIG. 1) to a second, operational, position (shown in the right side of FIG. 1). In the first, rest, position the axis 38A of the portion of the carrier 38 near to the sample container 42 is substantially parallel to the axis of rotation 12A. In the second, operational, position the axis 38A of the carrier 38 near to the sample container 42 is substantially perpendicular to the axis 12A. The axis 38A of the carrier 38 is collinear with the axis 42A of the sample container 42A. The movement of the carrier 38 and the sample container 42 carried thereby is accommodated by the flexible deformation of the material of the carrier 38 rather than by the pivotal movement of rigid members with respect to each other. The same material that deforms to accommodate motion of the carrier also accepts the tensile load imposed on the sample container 42 and the carrier 38 by centrifugal force.

As seen in FIGS. 1 and 2 each sample carrier 38 there shown is an elongated element in which the fibers are arranged in the textile structure of strands 46. By "strand" it is meant any twisted, braided, interlaced, plaited or essentially parallel array of fibers formed into a cord. Preferably, but not necessarily, the strands 46 pass substantially radially across the hub 12 and are attached at their midpoints to the hub 12. Alternatively, the strands may take a partial wrap of any predetermined angular distance (including substantially 180°) about the hub 12. At least one radially outward end of the element 38 the strands 46 are interconnected to define a sling-like socket 48. The strands 46 are formed from a high strength fiber material such as the aramid fiber manufactured and sold by E. I. du Pont de Nemours and Co. under the trademark KEVLAR®. Of course, other suitable materials may be used.

Figure 9:
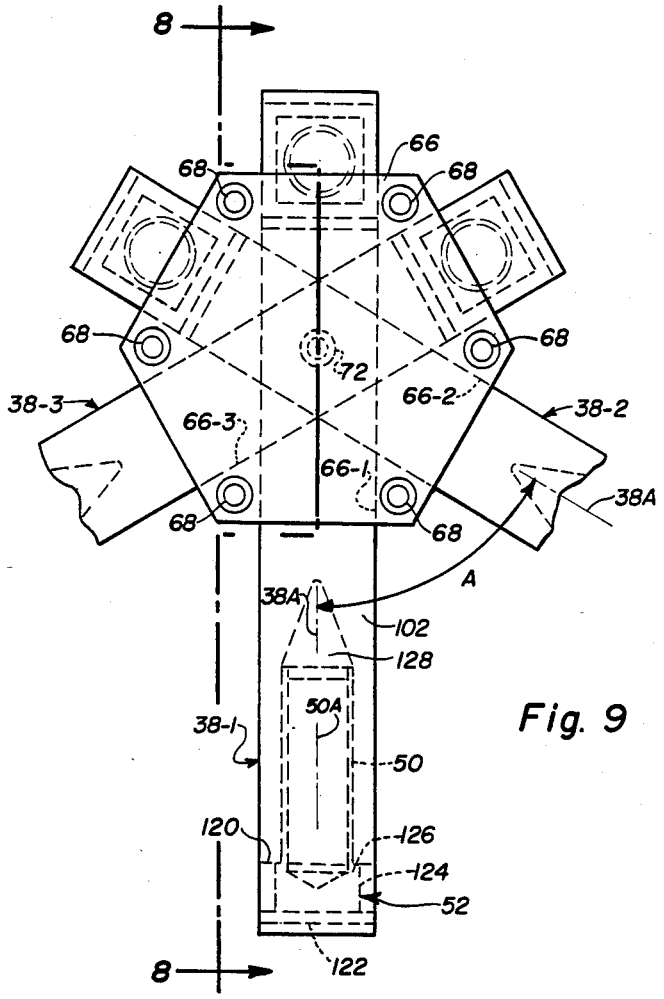

As will be developed the socket 48 may be formed by connecting the strands 46 to themselves either with or without the use of suitable "helper" yarns. In addition, as is also set forth herein, each socket 48 may be rigidized, preferably by resin impregnation, to develop in the socket 48 sufficient strength to resist the pressure exerted within the sample by centrifugation. If the socket 48 can be formed to exhibit the requisite strength the socket may directly receive the sample container 42. Alternatively the socket 48 accepts a vessel 50. The vessel 50 is a thin walled element which provides an impervious member about a liquid sample. The axis 50A of the vessel is collinear to the axis 38A. The use of a vessel 50 may mandate the use of a suitable force transmitting element 52 which preferably takes the form of a saddle (FIGS. 3 and 4) or a footing (FIGS. 8 and 9). The transmitting element 52 serves to transmit loads that are imposed on the sample container 42 to the flexible carrier 38 so as to impart a substantially uniform stress to the fibers of the carrier.

The strands are relatively lightly interconnected to provide a more consolidated structure intermediate hub 12 and the radial ends of the carrier but not to the extent where the flexibility of the carrier is impaired. As the strands 46 pass radially inwardly toward the hub 12 they cooperate to define gaps 58 (FIG. 2) through which access is afforded to the sample container 42.

As alluded to earlier the carrier 38 may be rigidized, as by resin impregnation, in a central region 60 that lies in the vicinity of the hub 12 and in the radial outer regions 62. However, that portion of the carrier 38 intermediate the rigidized regions 60 and 62 defines the flexibly deformable region 40. This region 40 may be impregnated with a nonrigidizing matrix that improves to surface characteristics without impairing its flexibility.

To manufacture the carrier element 38 shown in FIGS. 1 and 2, a single strand of fiber may be looped about a central mandrel to form one, two or more sockets. The mandrel may become a permanent part of the fabricated rotor or may be removed. A collar having a number of articulating arms is slip fit to the mandrel. The arms can be extended and made rigid during a winding phase and relaxed when the winding is complete. Each end of each arm may carry an end member which replicates the size and features of a vessel carried in the socket. The strand is wound about the mandrel and the number of ends to form the desired number of sockets. The strand should uniformly surround each end and, therefore, the winding angle of each pass must be slightly varied. A matrix material or the addition of helper yarns may be necessary to maintain the position of the strand. The sample carrier may be impregnated to define the rigidized regions 60, 62 discussed above.

In FIGS. 1 and 2 the rotor 10 is shown as fabricated from a plurality, e.g., three, sample carriers 38-1, 38-2 and 38-3 which are layered over the hub 12. Of course, any convenient number of carriers 38 may be received on the hub 12. The particular number and arrangement of carriers 38 selected will determine the sample capacity (in terms of container places) of the rotor 10. The axis of each carrier 38 is arranged at a predetermined angle A (FIG. 2) with respect to the axis of the adjacent carrier. A clamp plate 66 is secured to the hub 12, as by bolts 68, to secure the layered carriers 38 to the hub 12. The bolts 68 appear in side elevation only in FIG. 1.

To accommodate the plural layered carriers 38 the lower surface of the clamp plate 66 and/or the upper surface of the base 26 of the hub 12 are provided with radially extending grooves 66-1, 66-2 and 66-3. In the Figures only the clamp plate 66 is grooved. The axis of each groove is coincident with the axis of one of the layered carriers. The depth of any one of the grooves 66 is sufficient to accommodate the carrier received in that groove plus the carriers layered above it which lie in other grooves. Generally the depth of each groove is an integer multiple of the height dimension of a stacked carrier taken at the hub. Centering the carriers 38 within the grooves may be provided by adhering at least one side of each carrier to a thin metal plate 70 in the form of a modified cross that enters into at least two adjacent grooves. The carriers 38 may alternatively be drilled at their center or have a hole formed therein which allows the fibers in the carrier to pass therearound in a streamline fashion and a central shoulder bolt 72 provided through the clamp plate 66 and into the base 26. (The bolt 72 is shown in phantom only in the plan views of FIGS. 2, 4, 6 and 9). The carrier 38 may be held in the correct position on the base 26 by mechanical expedients (e.g., clamps, pins or bolts), by cement or adhesive or by special geometries (e.g., positioning plates or grooves).

In operation, as the rotor 10 is spun the sample containers 42 carried in the vessels 50 or directly received in the sockets 48 move from the first, rest, position shown on the left side of FIG. 1 (in which the axis 38A of each of the carriers 38 lies substantially parallel to the spin axis 12A) to a second, operational, position (in which the axis 38A of each of the carriers 38 is substantially perpendicular to the spin axis). The motion is accommodated by the flexing of the nonimpregnated flexibly deformable region 40 of each carrier 38. Under deceleration the reverse motion occurs.

In accordance with another embodiment of the present invention carrier 38 is arranged in a braided textile structure. In one aspect the braided textile structure is defined from a braided cord 76 attached to both the hub 12 and at least one force transmitting element 52. In the preferred case the cord is provided with closed eyelets 78A and 78B at each end thereof. The eyelets 78 are preferably formed using an eye-splice in which the end of the cord 76 is spliced back into the cord body to form an eyelet although any suitable technique may be used.

Figure 3:
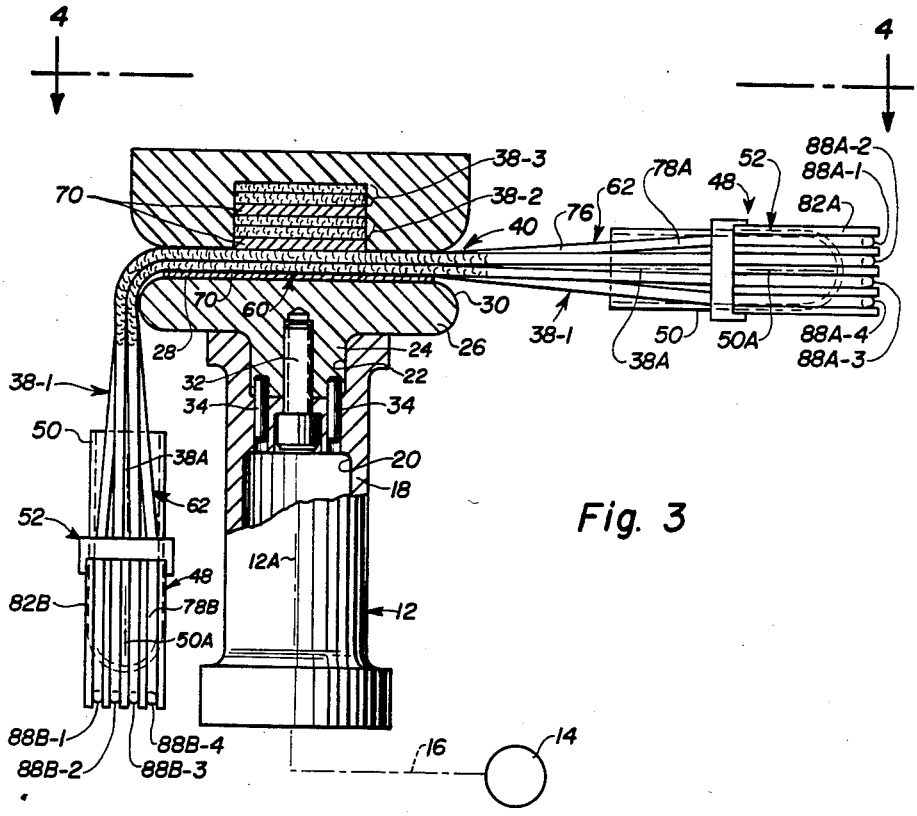
FIGS. 3 and 4 are views similar to FIGS. 1 and 2, respectively, illustrating a centrifuge rotor having a layered stack of flexible carriers in accordance with another embodiment of the present invention in which the textile structure of each carrier is arranged in a braid.
Figure 4:
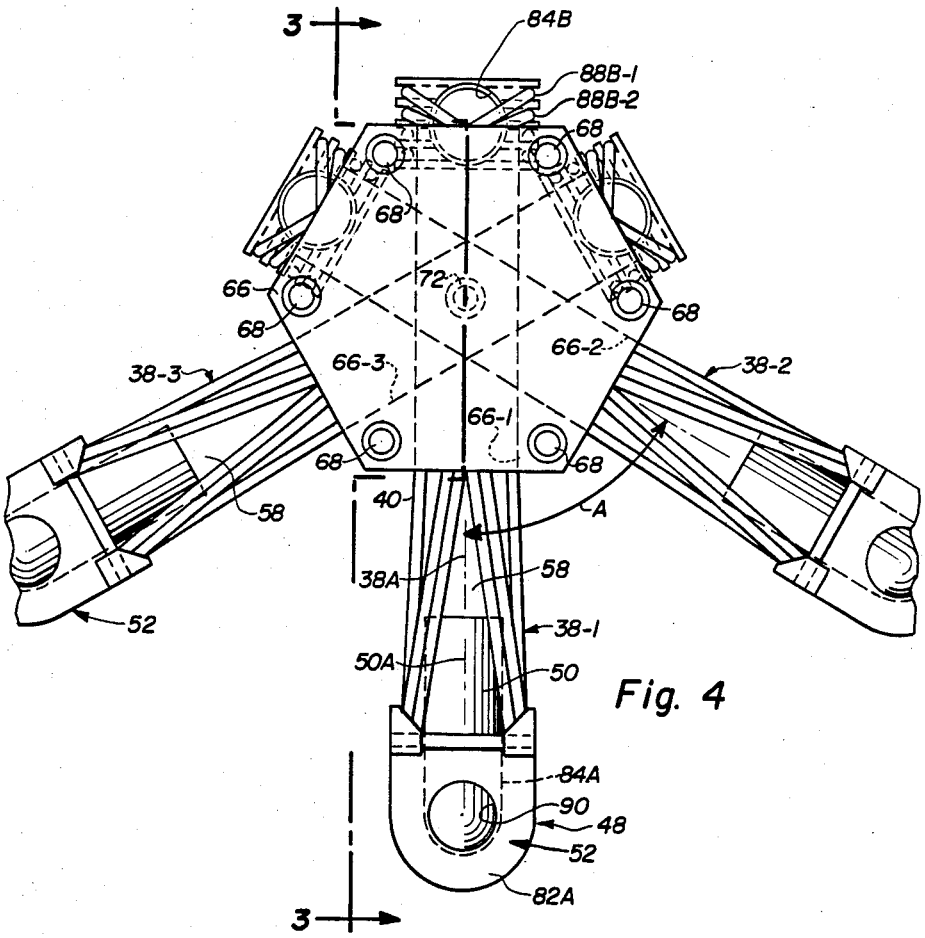

In the preferred instance the force transmitting element 52 takes the form of a horseshoe-shaped saddle 82. The saddle 82 is provided with a central bore 84 which receives the vessel 50. A sample container may be received in the vessel 50. The exterior surface of each saddle 76 is provided with an array of grooves 88-1, 88-2, 88-3, and 88-4 to facilitate the wrapping of the saddles with the cord 76. As seen in FIGS. 3 and 4 two saddles 82 are provided on each carrier 38 and are denoted by the characters 82A and 82B respectively, although it is to be noted that a carrier 38 in accordance with this aspect of the invention may be formed using a single saddle 82. In this instance both eyelets 78A, 78B surround the same saddle.

One winding pattern that has been found useful in forming a braided structure from a cord 76 having eyelets 78A and 78B at each end thereof may be described. The eyelet 78A is provided in the groove 88A-1 of the saddle 88A. The cord 76 is then wrapped sequentially around the grooves 88B-1, 88A-1 and 88B-1. Thereafter the cord 76 is wrapped about the grooves 88A-2, 88B-2, 88A-2 and 88B-2. In order to form a mirror image the cord 76 is temporarily positioned (but not permitted to seat) in the groove 88A-3 and then provisionally positioned into the groove 88B-3. The cord 76 thereafter wraps around the groove 88A-3 underneath the previously deposited wrap, thence to the groove 88B-3 underneath the previously deposited wrap. The provisionally held wraps are then seated. The cord 76 then provisionally loops the grooves 88A-4 and 88B-4. The cord 76 wraps the groove 88A-4 underneath the previously deposited wrap and finally to the groove 88B-4 where the eyelet 78B is disposed underneath the previously deposited wrap. The provisionally held wraps are then seated. To equalize lengths the saddles 82A and 82B are oscillated at loads up to approximately twenty-five percent of the breaking strength of the system so formed for a minimum of ten repetitions. The apertures 90 (FIG. 4) in each saddle 82 facilitate the insertion onto the oscillating device. The structure may be rigidized by impregnation to define the regions 60, 62 therein. Access openings 58 are defined. A rotor 10 may be formed of plural layers of carriers 38 as discussed above.

Figure 5:
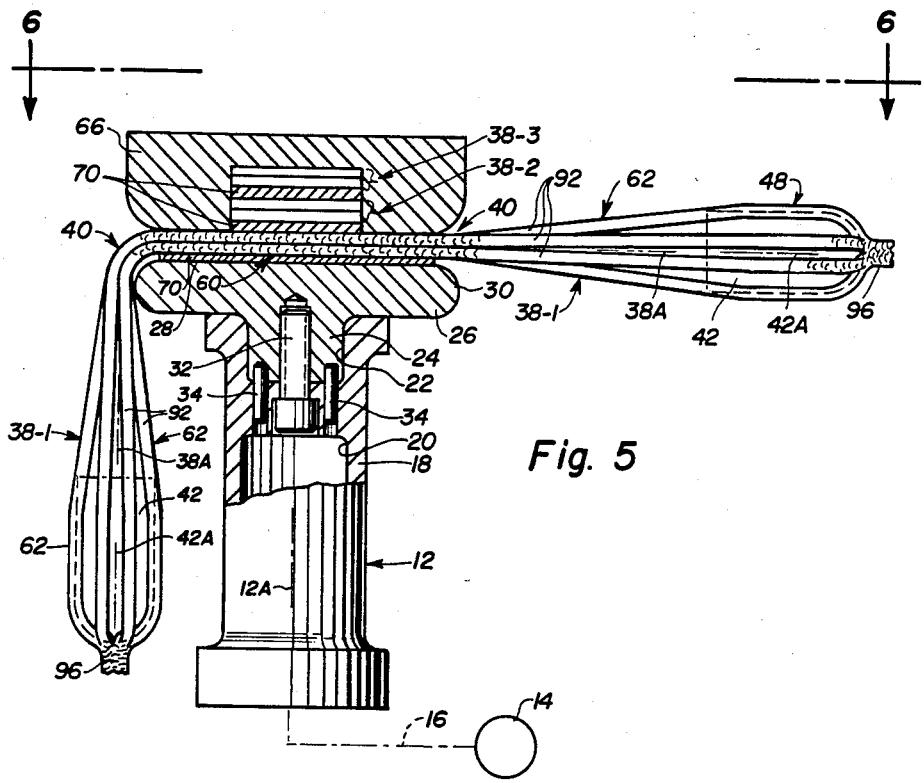
FIGS. 5 and 6 are views similar to FIGS. 3 and 4, respectively illustrating a centrifuge rotor having a layered stack of flexible carriers in accordance with still another embodiment of the present invention in which the textile structure of each carrier is again arranged in a braid.
Figure 6:
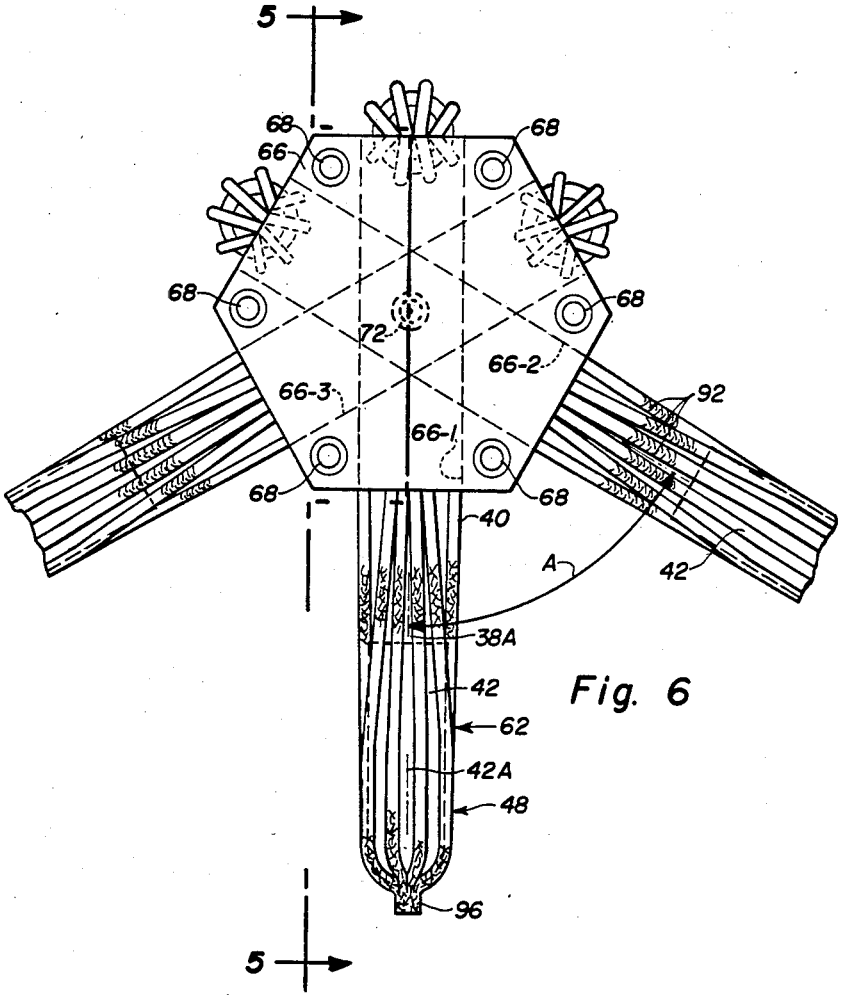

In the embodiment of FIGS. 5 and 6 the braided structure used to form the carrier 38 is defined from a plurality of cords 92 (each of which is itself a braid in the most preferred case). The cords 92 are radially and coaxially disposed in the vicinity of the hub 12 while the free ends thereof are braided to form the socket 48. The preferred mode of forming the socket 48 is shown in FIG. 7 in which the cords 92 are interlaced by helper yarns 92 which pass over and under the cords 92. The free ends of the helper yarns 94 and the free ends of the cords 92 are consolidated, as at 96, by any suitable expedient, such as braiding. Alternately, the fibers which form the braided cords 92 may be used to braid the socket 48, with the ends suitably consolidated. In an alternative mode, the free ends of the cords 92 and the helper yarns 94 (or the ends of the fibers which form the cords 92) may be braided back onto themselves, thus eliminating the need for consolidated region 96. If the socket 48 exhibits sufficient strength to contain pressure exerted by the liquid sample during centrifugation the container 42 may be directly received within the socket 48 (FIGS. 5 and 6). Alternatively the vessel 50 is provided within the socket 48.

The carrier 38 is rigidized in both the central and radial outward regions 60 and 62, respectively. Rigidizing the outer region 62 assists in maintaining the braid of the socket 48 regardless of the manner in which the socket is formed.

The cords 92 need not extend radially across the hub 12, but may be bent 180° so that each end of each cord 92 is adjacent. These ends may then be used to form a carrier 38 with a single socket 48. In this case a substantial load resisting attachment must be provided to the hub. Suitable access openings 58 may be provided whereby access to the container 42 may be had while the carrier 38 is in the first position.

Carriers 38 may be layered across the hub akin to the situation discussed in connection with FIGS. 1 and 2. The clamping action of the plate 66 in cooperative association with the base 26 secures the carriers 38 to the hub 12 as discussed above. In both braided embodiments the cord 76 or the cords 92 may be made from the same material as used for the strands.

As seen from FIGS. 8 and 9 the sample carrier 38 arranged in a woven textile structure is defined from a woven belt or strap 102. The strap 102 is woven from high strength fiber material such as that used for the strands or the braids. Preferably a majority of the fibers of the belt 102 are arranged longitudinally, that is, as the warp of the weave and parallel to the axis 38A. This pattern is preferred to enhance the strength of the belt 102 in the direction of its exposure to maximum load.

Figure 10:
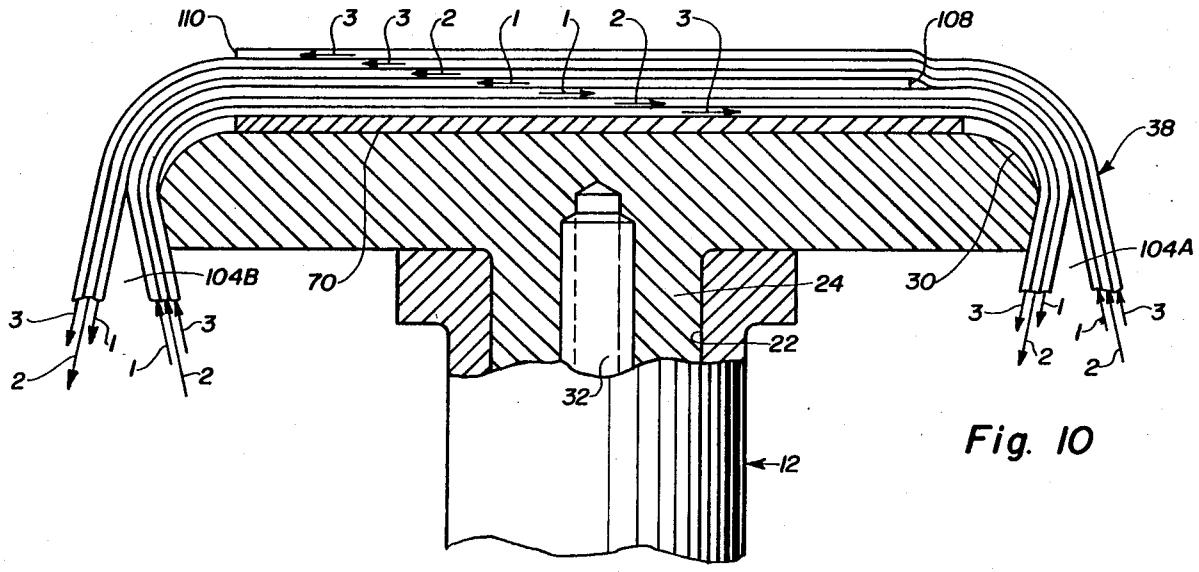
FIG. 10 is an enlarged view of the portion of the woven strap used to form the carrier shown in FIGS. 8 and 9 in the vicinity of the rotor hub.

The belt 102 is overlaid back onto itself to form, in bowtie-like fashion, one or more lobes 104. A pair of lobes 104A, 104B, one at each radial end of the carrier 38, is preferred. Preferably the belt 102 is overlaid in such a manner that a plurality of plies of woven material is defined. As seen from FIG. 10 the direction of looping is indicated with the numbered arrows illustrating the plies in each direction. Starting with an end 108 the belt 102 is wrapped back on itself such that at least three plies extend in each of two opposed radial directions across the hub 12. The plies are thus overlapped six deep across the face of the hub 12. In the vicinity of the periphery 30 of the hub 12 the plies heading in opposed directions diverge to define the lobes 104. The free end 110 of the belt 102 is disposed either above or below the overlaid plies depending upon the direction of looping. At least six plies are preferred to enhance the radial strength while simultaneously providing flexibility of the carrier. The stacked plies define a height dimension 116. Alternately the woven carrier 38 may be formed from a number of nested endless straps.

On the interior surface of the radially outer ends of each lobe 104 is disposed a force transmitting member 52 in the form of footing 120. The exterior surface 122 of the footing 120 is configured for close fitting receipt on the curving interior turn of the respective lobe 104 in which the footing 120 is disposed. The footing 120 has a pocket 124 on the inner surface thereof. The vessel 50 having an enlarged cylindrical base 126 is removably receivable in the pocket 124 in the footing 120. The sample container 42 carrying the sample under test may be received within the vessel 50. The vessel 50 is closed by a conical stopper 128. The vessel 50 is movable with respect to the footing 120 along the interface defined between the base 126. The vessel 50 is removable sidewise of the carrier 38 via the access opening 58 defined between plies of the belt 102.

A plurality of carriers 38 may be layered, as in previous instances, across the hub 12.

Figure 11:
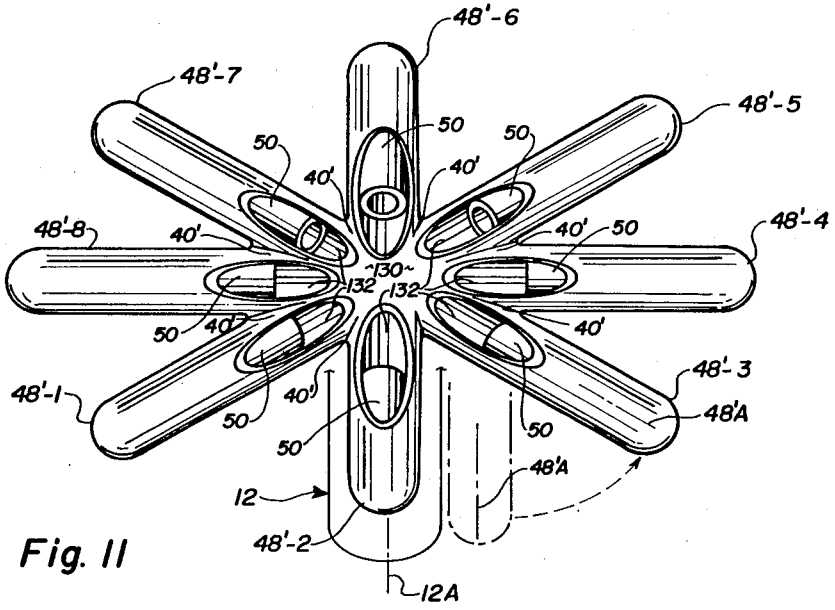
FIG. 11 is a highly stylized perspective view of an alternate embodiment of a flexible carrier in accordance with the present invention.

In some instances it may be desirable to form a rotor with a sample capacity (in terms of container places) that is greater than two without the necessity of layering a plurality of carriers 38. This may be accomplished by a carrier 38' shown in FIG. 11. In this embodiment the fibers defining the individual sockets 48'-1 through 48'-8 are interconnected into a central web region 130 so that the carrier 38' is one integral textile structure.

One continuous yarn may be used to form the carrier 38' or a number of yarns added and subtracted during fabrication to insure a balanced, uniform stress pattern throughout the structure. The carrier 38' is suitably connected above or below the surface of the web 130 to the hub 12. The web 130 may be rigidized to define the region 60, as discussed. The flexible region 40 is defined in the region between the periphery of the hub 12 and the radiating sockets 48. The sockets 48 may be rigidized in the web and at the ends, as discussed. A vessel 50 may be disposed within each socket 48' if desired or necessary. Each socket 48' is provided with an access slot 132 by which access to the interior of the socket 48' may be afforded. In operation the movement of each socket 48' from the first, rest, position in which its axis 48'A is substantially parallel to the axis of rotation 12A to the second, operational, position in which the axis 48'A is substantially perpendicular to the axis 12A is accommodated by the flexible deformation of the carrier 38' in the regions 40'. The carrier 38' is formed in a braided textile structure in the preferred case.

The stiffness and thickness of the flexibly deformable region 40 is such that the weight of the carriers 38, 38' and/or vessels and/or sample containers load may not permit gravity to fully restore the carriers from the operational to the rest position. Accordingly it may be necessary to provide a mechanism to assist in restoring the carriers 38, 38' to the first, rest, position. Such a mechanism is provided by a restoring cap assembly 140 in accordance with any embodiment of the present invention. It should be understood that any embodiment of the restoring cap assembly 140 shown in FIGS. 12 through 21 may be used with any embodiment of the flexible carrier 38, 38' previously described so long as suitable provision is made in the cap assembly 140 to remove the sample from the carrier 38, 38' in which it is spun. In the FIGS. 12 through 23 the flexible carrier is shown only in outline form.

The cap assembly 140 in the embodiment shown in FIGS. 12 to 21 includes a substantially inverted cup shaped member formed from an annular disk 142 with a central collar 144 having an aperture 145 therein. A skirt 146 depends from the periphery of the disk 142. The lower end of the skirt 146 is provided with diametrical pairs of scallops 148A, 148B and 148C, as may be best seen from the developed view of the skirt 146 shown in FIG. 13. Using a baseline 150 defined by a line that passes through the lowest point on each scallop 148 as a reference, it is seen that the scallops 148 extend various predetermined heights 152, 154, 156 above the baseline 150. Moreover the high points of adjacent scallops 148 are vertically offset, as shown at 158, 160 and 162.

In accordance with this invention the number of pairs of scallops 148 and the number of different predetermined heights 152, 154 and 156 that the scallops extend above the baseline 150 corresponds to the number of flexible sample carriers 38 used on the rotor 10. In the instance illustrated in FIGS. 12 and 13, if three carriers 38 are used, three different distances D1(152), D2(154) and D3(156) are defined. The scallops 148 having the greatest height dimension D3(156) are aligned with the carrier 38-3 that is the uppermost of the layered carriers while the least height dimension D1(152) is radially aligned with the lowermost carrier 38-1. The skirt 146 would be adjusted to provide an appropriate number of scallops 148 at the same predetermined height above the baseline 150 to accommodate the sockets 48' of a carrier 38'.

Figure 12:
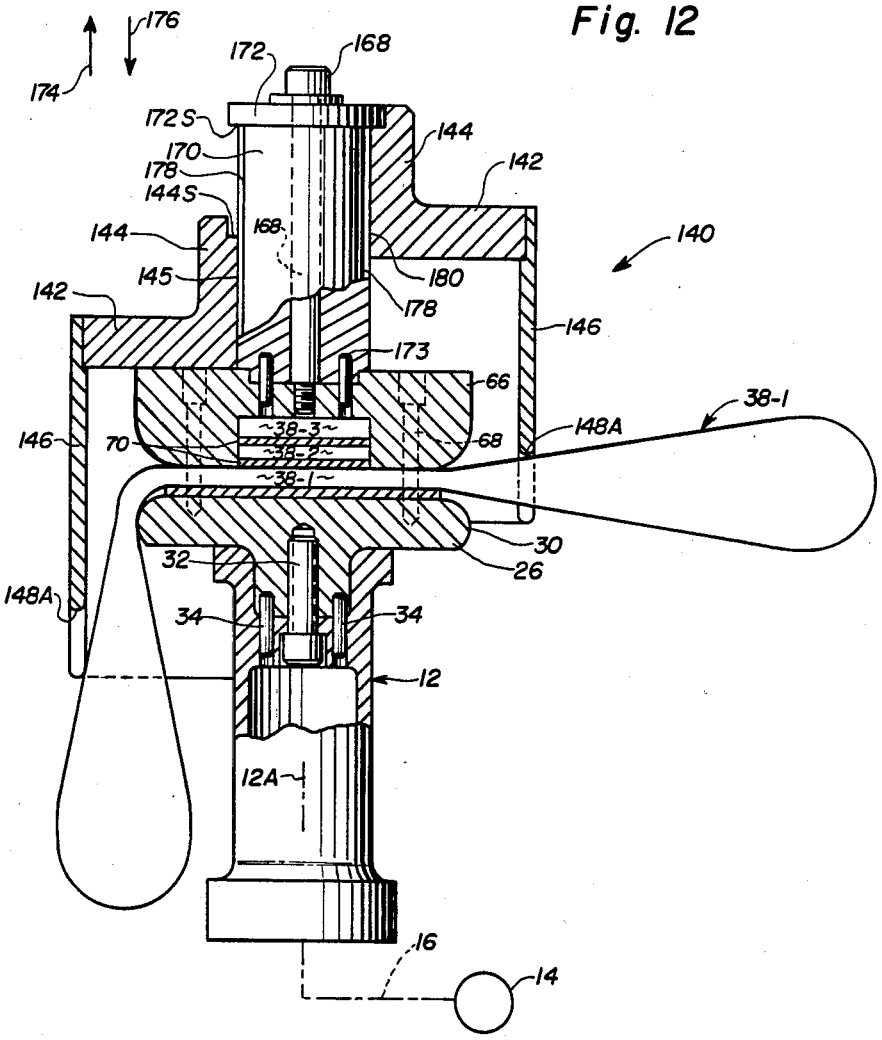
FIG. 12 is a side elevational view in section of a restoring cap assembly generally used with a flexible carrier (shown in outline) in accordance with the present invention with the cap on the left side of the Figure in the initial position and on the right side of the Figure in the raised position.
Figure 13:
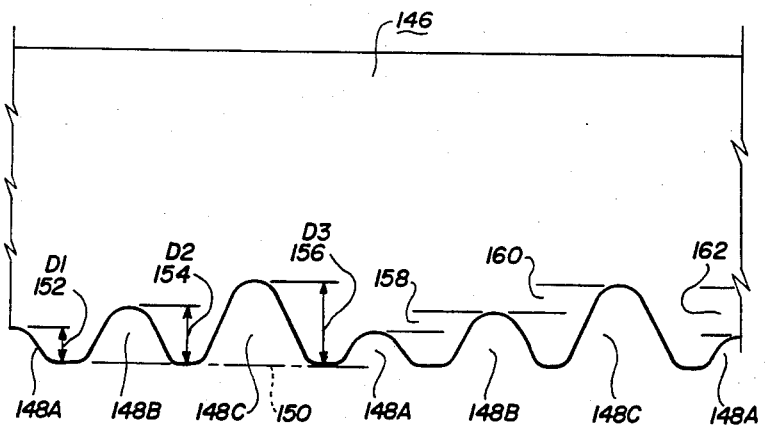
FIG. 13 is a developed view of the skirt portion of the restoring cap assembly shown in FIG. 12.
Figure 16:
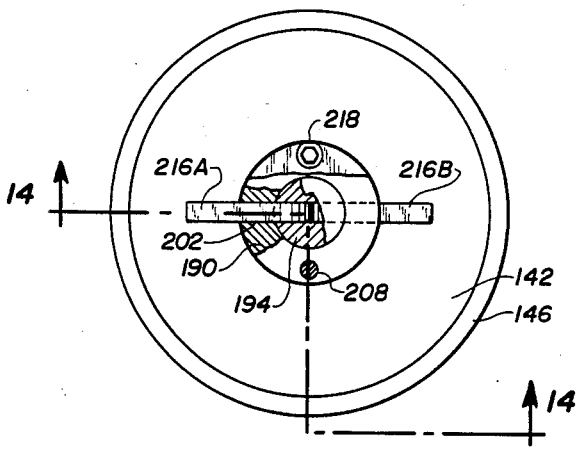
FIG. 16 is a plan view taken of the restoring cap assembly taken along view lines 16—16 of FIG. 14 with portions broken away.

Mounted to the upper surface of the clamping plate 66 as by an axially extending bolt 168 is an upstanding post 170. The clamp plate 66, by virtue of its attachment to the disk portion 26 by means of the countersunk bolts 68, may be essentially viewed as a part of the hub 12. It is noted that the bolts 68 are shown only in FIG. 12 for clarity of illustration. It is to be understood that the clamp plate 66 shown in FIGS. 14, 15, 16, 18, 20 and 22 is attached to the hub 12 for rotation therewith. The upper end of the post 170 in the embodiment of FIG. 12 is provided with an enlarged head 172. The post 170 is driven with the clamp plate 66 by an array of drive pins 173. The cap 140 is slidably received on the post 170 for movement in the direction of the arrows 174, 176 parallel to the axis of rotation 12A. Relative rotation therebetween is prevented by a key 178 that extends radially from the post 170 and engage into notches 180 provided in the collar 144.

The operation of the cap assembly 140 may be understood from FIG. 12 in which the left hand side of the Figure depicts the situation extant with the sample carriers 38, 38' in the first, rest, position while the right side of the Figure depicts the situation with these elements in the second, operational, position. At rest the radial ends of the carriers 38, 38' hang over the rounded edge 30 of the hub 12 and the cap 140 occupies its initial position in which the undersurface of the disk 142 lays atop the upper surface of the clamp plate 66. As the rotor 10 is spun the sample containers are impelled to the second position. This movement is accommodated by the flexible deformation of the carrier 38, 38' as discussed above. As it moves the carrier 38 abuts the scallops 148 lifting the cap 140 in the direction 174 (parallel to the axis of rotation 12A). The cap 140 thus responds to centrifugal force to displace in the direction 174 to the final, raised, position. The cap 140 remains elevated at its raised position while the rotor 10 is at operating speed. The upward moement of the cap 140 is limited by abutment between the annular shoulder 144S on the collar and the surface 172S on the underside of the enlarged head 172.

As the rotor 10 slows the cap 140 begins to move in the direction 176. The weight of the cap 140 is impressed upon the carriers 38, 38' as the cap 140 responds to gravity thereby assisting the return of the carriers 38, 38' and the containers carried thereby to the first position.

In some instances it may be desirable to provide a lifting mechanism to assist in lifting the cap 140 to the raised position. The embodiments of the invention shown in FIGS. 14 through 21 include such a lifting mechanism.

In this embodiment of the invention shown in FIGS. 14 through 17 the post 170' has a hollow interior region as indicated at 172 and has diametrically opposed slots 180A, 180B (FIG. 17) which extend substantially along the length thereof. The collar 144 is slidably received on the post 170' for relative motion in the directions 174, 176 parallel to the axis of rotation 12A. The lower end of the post 170' is provided with an enlarged base 182 whereby the post 170' may be secured to the clamp plate 66 by an array of bolts 168'. The underside of the disk 142 is recessed, as at 184 (FIG. 17), to accommodate the heads of the bolts 168'. The collar 144 is provided with registered openings 186A, 186B which register with the slots 180A, 180B, respectively.

Figure 15:
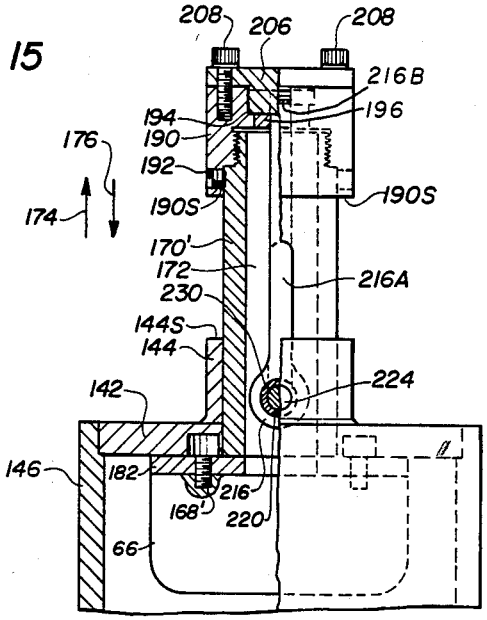
Figure 17:
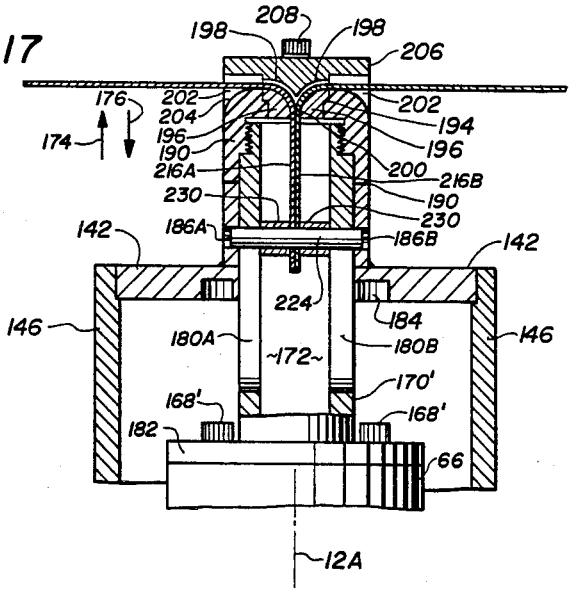
FIG. 17 is a side sectional view of the restoring cap assembly shown in FIGS. 14 and 15 with the cap in the raised position.

The upper end of the post 170' is threaded to receive a guide holder 190 which is secured nonrotationally to the post 170' by set screws 192 (FIG. 15). A pair of stepped seats 194 are formed within the upper portion of the guide holder 190. Each seat 194 receives a guide member 196. The guides 196 are each provided with a groove 198 which, when registered, define an axially extending channel 200 which communicates with the hollow interior 172 of the post 170'. The grooves 198 continue over the upper surface of the guides 196 and radially register with notes 202 provided in diametrically opposed relation in the guide holder 190. The rims of the notches 202 are rounded, as at 204. A cover plate 206 is suitably secured to the upper surface of the guide holder 190 by bolts 208.

A pair of elongated ribbons 216A and 216B extend through the hollow interior 172 of the post 170', through the channel 200 defined between the confronting guides 196, and radially outwardly of the holder 190 through the grooves 198 and notches 202. The lower end of each ribbon is enlarged, as at 218 (FIG. 15), and is provided with an eye opening 220. The cap assembly 140 is planned to the ribbons 216 by a radially extending pin 224 which extends through one of the openings 186A in the collar 144, into the post 170' through the slot 180A corresponding to the one opening 186A, through the registered eyes 220 at the lower ends of the ribbons 216, and then through the other of the slots 180B and the opening 186A. Spacers 230 stand the pin 224 off the inner surface of the post 170'. The ribbons 216 are formed of a suitably dense material, as chrome steel, and configured to exert a predetermined lifting force on the cap assembly 140 derived in a manner to be discussed.

Figure 14:
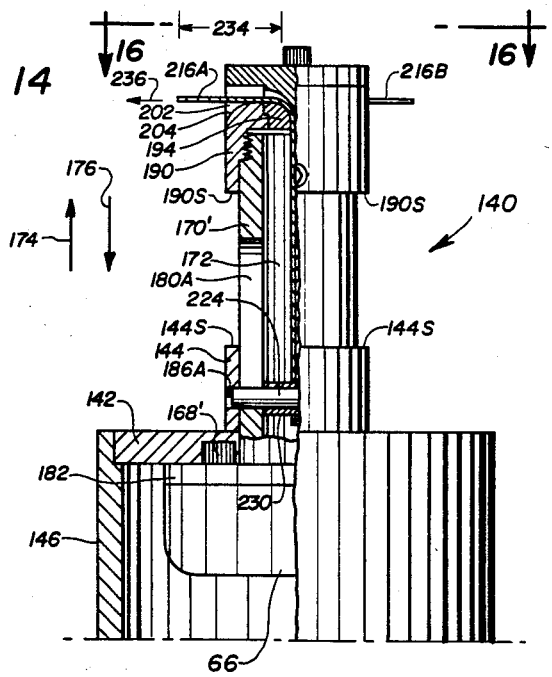
FIGS. 14 and 15 are, respectively, a front and a side elevational view of the restoring cap assembly used with a flexible carrier in accordance with the present invention with the cap in the initial position.

In operation, in the initial position, best shown in FIGS. 14 and 15, the undersurface of the disk 142 abuts the base 182 of the post 170'. A predetermined length 234 (FIG. 14) of the upper end of the ribbons 216 extends radially outwardly of the guide holder 190. As the rotor rotates centrifugal force acts on the radially projecting portions 234 of the ribbons 216 drawing the ribbons radially upwardly in the direction of the arrows 236. Concomitantly, the radial outward motion of the ribbons 216 lifts the cap assembly 140 in the upward direction 174 via the interconnection of the lower ends of the ribbons 216 to the collar 144 of the cap 140 through the pin 224. Thus as the rotor spins and the flexible carriers 38, 38' move as earlier discussed the ribbons 216 cooperate to lift the cap 140 from the initial position to the final, raised, position (shown in FIG. 17). The action of the carrier 38, 38' against the skirt 146 assists in lifting the cap 140. Upward motion of the cap assembly 140 is arrested by the abutment between the upper surface 144S of the collar 144 with the annular undershoulder 190S of the guide holder 190.

As the rotor slows the cap assembly 140 is lowered in counter direction 176 as the weight of the cap 140 overbalances the lifting force generated by the action of centrifugal force on the ribbons 216. The restoring action of the skirt 146 on the carriers 40 urges the return of the carriers 38, 38' from the second to the first position.

Figure 19:
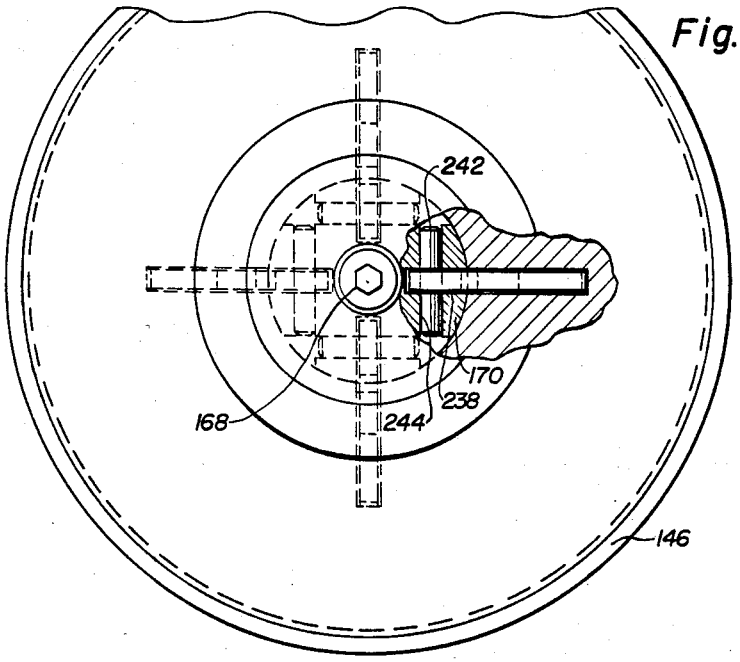
FIG. 19 is a plan view thereof with portions broken away.
Figure 18:
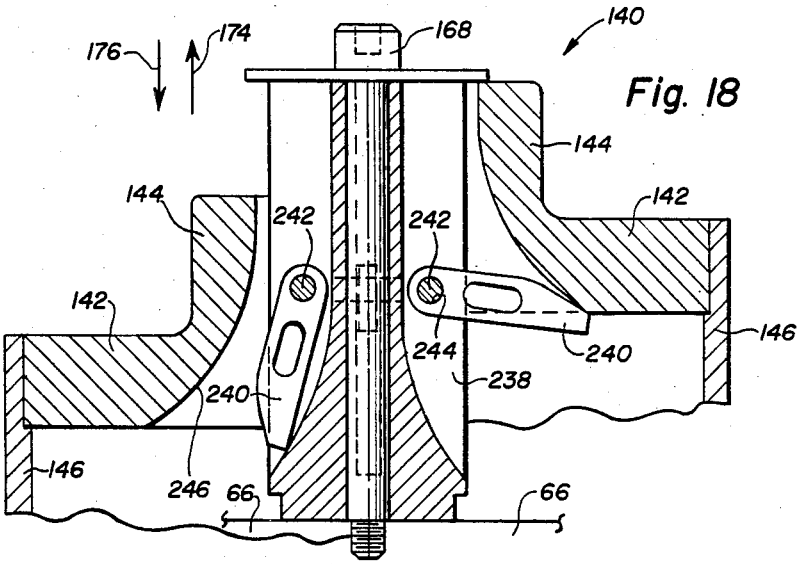

In the embodiment of the cap 140 shown in FIGS. 18 and 19 the post 170 is modified to provide longitudinally extending slots 238 along a portion thereof. Pivotally mounted in the slots 238 are pivot elements 240. The elements 240 are mounted on pins 242 received in bores 244 formed in the portion of the post 170 defining the slots 238. The inner surface of the core 142 is provided with cam follower surface 246.

In operation, while in the initial position shown in the left side of FIG. 18 the pivot elements 240 hang in a retracted position within the slots 238. As the rotor 10 spins centrifugal force urges the pivot elements 240 radially outwardly into contact with the cam surfaces 242. This action lifts the cap 140 along the post 170 in the upward direction of the arrow 174. As the rotor slows the weight of the cap 140 becomes dominant, urging the carriers 38, 38' to the first position. Any predetermined number of pivot elements 240 and corresponding surfaces 242 may be used.

Figure 21:
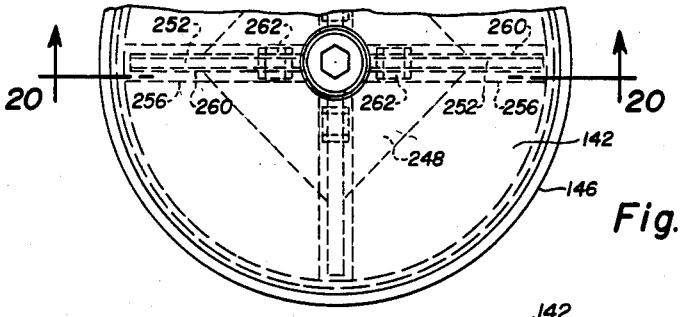
FIG. 21 is a plan view thereof.
Figure 20:
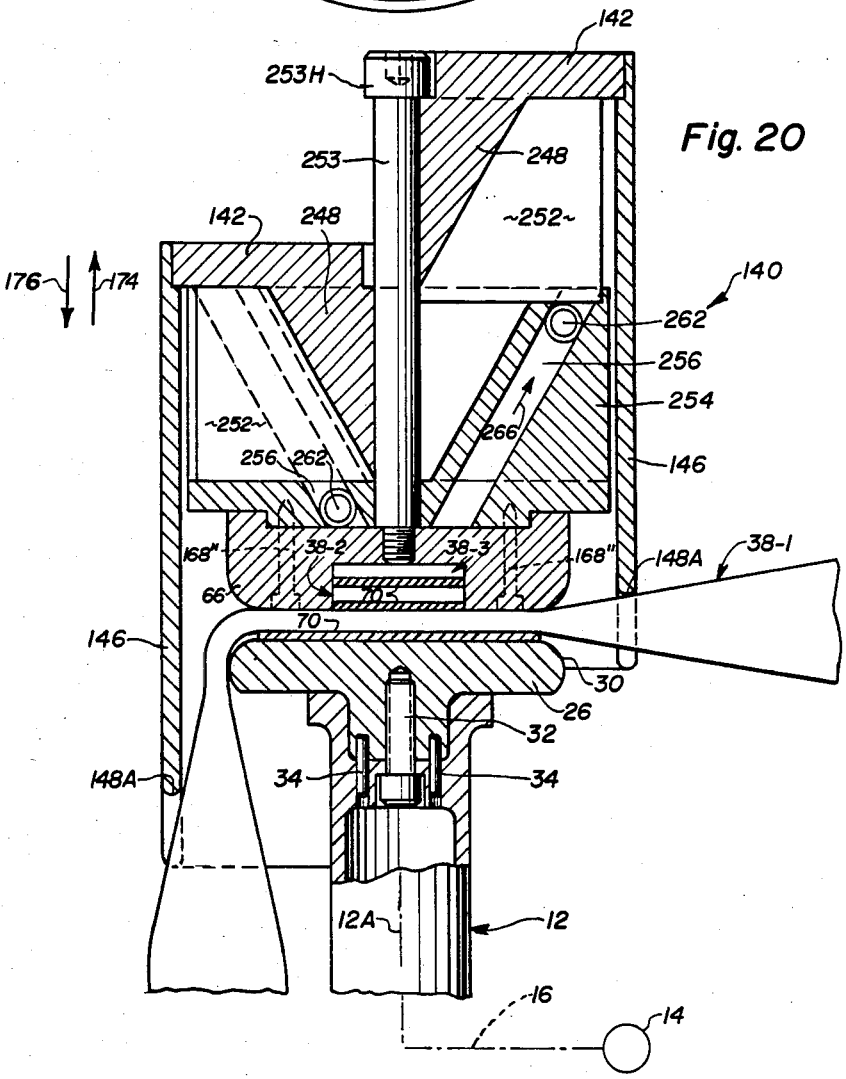

With reference to FIGS. 20 and 21 shown is still another alternate embodiment of the cap assembly 140 embodying the teachings of the present invention. In this embodiment the disk 142 is provided with a tapering central member 248 having an array of radially outwardly extending arms 252. The disk 142 is slidable in the direction 174, 176 along a guide bolt 253 threaded to the clamp plate 66.

In this embodiment, attached to the upper surface of the clamping plate 66 by an array of bolt 168" is a central core 254. The central core 254 includes an array of generally upwardly and outwardly inclined trackways 256. An array of radially extending slots 260 is provided in the member 254 with each slot 260 interrupting each trackway 256. Trapped within each trackway 256 is a lifting lug 262. In the assembled state the arms 252 of the central portion 248 are received within the slots 260 such that the arms 252 pass through each trackway 256.

In operation, with the rotor 10 at the rest as seen in the left side of FIG. 20 the lugs 262 repose lower ends of the trackways 256 with the lower edge of the arms 252 resting above the lugs 262. As the rotor 10 is spun the lugs 262 are urged by centrifugal force to move within the trackways 256 in the direction of the arrows 266. The lugs 262 abut against the arms 252 which pass through the trackway 256. As the lugs 262 move in the trackway 256 they act against the arms 252 lifting the same in the direction 174 along the guide bolt 253. The upward motion of the disk 142 is limited by abutment with the shoulder 142S on the disk with the enlarged head 253H of the bolt 253, as seen in the right side of FIG. 20. As the rotor slows, the lugs 262 fall back into the lowest extremity of the trackway 256, with the arms 252 following suit in the direction 176 to lower the skirt 146.

Figure 23:
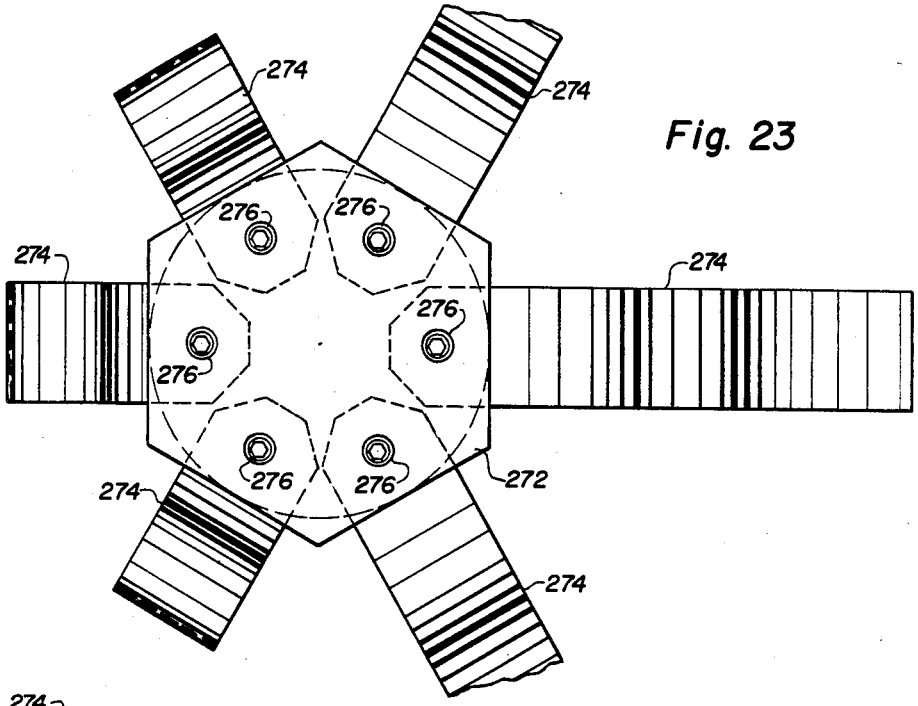
FIG. 22 is a side elevational view of still another embodiment of the restoring cap assembly used with a flexible carrier (shown in outline) in accordance with present invention and FIG. 23 is a plan view thereof.
Figure 22:
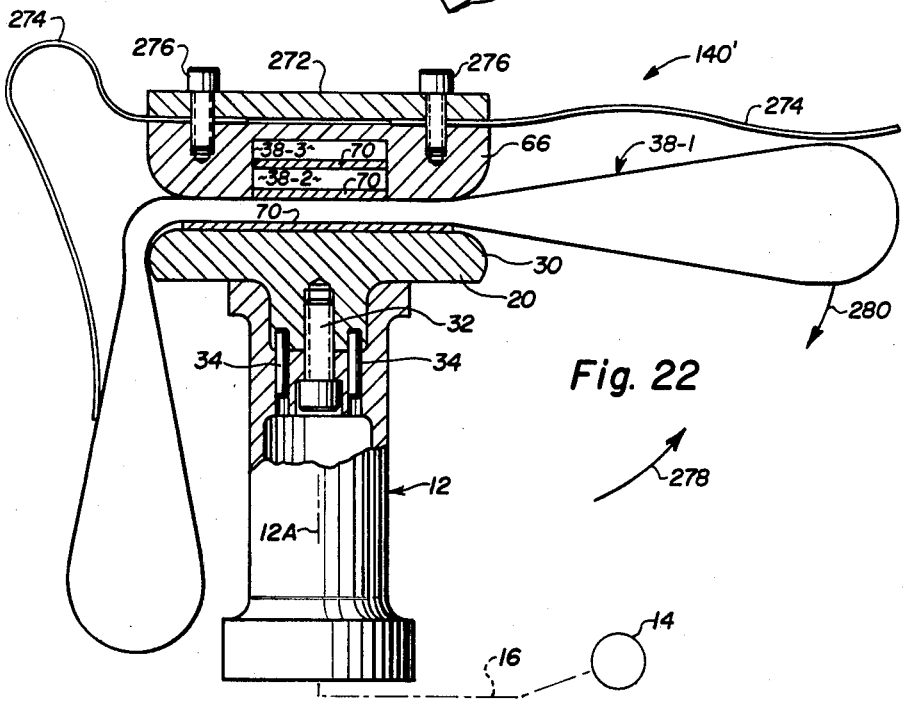

Shown in FIGS. 22 and 23 are side sectional and plan views showing an alternate embodiment of a cap assembly 140' of the present invention. In this embodiment the cap assembly 140' includes a disk 272 to which is appended an array of spring arms 274. The disk 272 and the arms 274 are secured to the plate 66 by the bolts 276. The number of spring arms 274 corresponds to the number of sample containers 40 supported in the sockets 48, 48' of the carriers 38, 38' on the rotor 10. The arms 274 are fabricated from any suitable material, such as chrome-vanadium springsteel.

In operation, as the rotor 10 is spun the centrifugal force effects on the free ends of the spring arms 274 causes them to lift upwardly and outwardly in the direction of arrows 278 until the carriers 38, 38' and the arms 274 occupy the position shown in the right side of FIG. 22. In this position the ends of the arms 274 lie above the ends of carriers 38, 38'. As the rotor slow the resiliency of the spring arms 274 again becomes dominant, urging the carriers 38, 38' in the direction 280 to the first position.

Those skilled in the art may appreciate that in view of the preferred embodiment of the invention as above described numerous modifications thereto may be effected. However these modifications are to be construed as lying within the scope of the present invention, as set forth in the appended claims.

What is claimed is:

1. A swinging bucket centrifuge rotor for exposing a sample disposed within a sample container to a centrifugal force field comprising:

a central hub connectable to a source of motive energy for rotating the hub about an axis of rotation; and a sample carrier connectable to the hub, the sample carrier itself comprising a plurality of fibers arranged in a predetermined textile structure, the sample carrier having a flexibly deformable region such that the carrier is adapted to support the sample container during movement of the same in response to centrifugal force from a first, rest, position in which the axis of a portion of carrier in the vicinity of the container is substantially parallel to the axis of rotation to a second, operational, position in which the axis of the carrier substantially perpendicular to the axis of rotation.

2. The centrifuge rotor of claim 1 wherein the hub has a periphery thereon and wherein the fibers of the sample carrier being interconnected at a point radially outwardly of the periphery of the hub to define at least one sling-like socket adapted to receive the sample container therein, the carrier having the deformable region between the hub and socket which flexes to accommodate the movement of the carrier as it moves from the first to the second position.

3. The centrifuge rotor of claim 2 wherein the socket further includes a helper yarn interconnected with the fibers defining the socket.

4. The centrifuge rotor of claim 3 wherein the socket is rigidized.

5. The centrifuge rotor of claim 2 wherein the socket is rigidized.

6. The centrifuge rotor of claim 2 wherein the textile structure takes the form of a plurality of strands.

7. The centrifuge rotor of claim 6 wherein the strand structure has gaps formed therein through which access to the sample container is afforded.

8. The centrifuge rotor of claim 2 wherein the textile structure takes the form of a weave.

9. The centrifuge rotor of claim 8 wherein the weave defines a belt of a high tensile strength material having at least one lobe spaced radially outwardly of the hub.

10. The centrifuge rotor of claim 9 wherein the belt is overlaid upon itself to define a plurality of plies over the hub, and wherein the majority of the fibers forming the belt extend longitudinally thereof.

11. The centrifuge rotor of claim 2 wherein the textile structure takes the form of a braid.

12. The centrifuge rotor of claim 11 wherein the braid is defined by a plurality of cords each extending substantially radially across the hub in generally parallel relationship with the other cords, the radially outer ends of the cords being braided together to define the socket.

13. The centrifuge rotor of claim 12 wherein the socket also includes a helper yarn braided with cords.

14. The centrifuge rotor of claim 12 wherein the cords are consolidated at a point radially outwardly of the socket.

15. The centrifuge rotor of claim 12 wherein the cords are braided back onto themselves in the region of the socket.

16. The centrifuge rotor of claim 2 further a second carrier disposed in an overlying layered relationship with respect to the first carrier.

17. The centrifuge rotor of claim 1 wherein the hub has a periphery thereon and wherein the fibers of the sample carrier being interconnected at a point radially outwardly of the periphery of the hub to define at least one sling-like socket, the socket being adapted to receive a vessel itself sized to receive the sample container therein, the carrier having the deformable region between the hub and socket which flexes to accommodate the movement of the carrier as it moves from the first to the second position.

18. The centrifuge rotor of claim 17 wherein the socket further includes a helper yarn interconnected with the fibers defining the socket.

19. The centrifuge rotor of claim 18 wherein the socket is rigidized.

20. The centrifuge rotor of claim 17 wherein the socket is rigidized.

21. The centrifuge rotor of claim 17 wherein the textile structure takes the form of a plurality of strands.

22. The centrifuge rotor of claim 21 wherein the strand structure has gaps formed therein through which access to the sample container is afforded.

23. The centrifuge rotor of claim 47 wherein the textile structure takes the form of a weave.

24. The centrifuge rotor of claim 23 wherein the weave defines a belt of a high tensile strength material having at least one lobe spaced radially outwardly of the hub.

25. The centrifuge rotor of claim 24 wherein the belt is overlaid upon itself to define a plurality of plies over the hub, and wherein the majority of the fibers forming the belt extend longitudinally thereof.

26. The centrifuge rotor of claim 17 wherein the textile structure takes the form of a braid.

27. The centrifuge rotor of claim 26 wherein the braid is defined by a plurality of cords each extending substantially radially across the hub in generally parallel relationship with the other cords, the radially outer ends of the cords being braided together to define the socket.

28. The centrifuge rotor of claim 27 wherein the socket also includes a helper yarn braided with cords.

29. The centrifuge rotor of claim 27 wherein the cords are consolidated at a point radially outwardly of the socket.

30. The centrifuge rotor of claim 27 wherein the cords are braided back onto themselves in the region of the socket.

31. The centrifuge rotor of claim 17 further a second carrier disposed in an overlying layered relationship with respect to the first carrier.

32. The centrifuge rotor of claim 1 wherein the hub has a periphery thereon and wherein the fibers of the sample carrier being interconnected at a point radially outwardly of the periphery of the hub to define at least one sling-like socket, the socket being adapted to receive a vessel itself sized to receive the sample container therein: and a force transmitting arrangement adapted to transmit tensile loads imposed on the sample container and the vessel to the fiber textile structure; the carrier having the deformable region between the hub and socket which flexes to accommodate the movement of the carrier as it moves from the first to the second position.

33. The centrifuge rotor of claim 32 wherein the socket further includes a helper yarn interconnected with the fibers defining the socket.

34. The centrifuge rotor of claim 33 wherein the socket is rigidized.

35. The centrifuge rotor of claim 32 wherein the socket is rigidized.

36. The centrifuge rotor of claim 32 wherein the textile structure takes the form of a plurality of strands.

37. The centrifuge rotor of claim 36 wherein the strand structure has gaps formed therein through which access to the sample container is afforded.

38. The centrifuge rotor of claim 32 wherein the textile structure takes the form of a weave.

39. The centrifuge rotor of claim 38 wherein the weave defines a belt of a high tensile strength material having at least one lobe spaced radially outwardly of the hub and wherein the force transmitting arrangement comprises a footing having an exterior surface configured for close fitting receipt within the lobe, the vessel being removably mounted to the footing.

40. The centrifuge rotor of claim 39 wherein the belt is overlaid upon itself to define a plurality of plies over the hub, and wherein the majority of the fibers forming the belt extend longitudinally thereof.

41. The centrifuge rotor of claim 39 wherein the vessel is movable with respect to the footing along an interface defined therebetween.

42. The centrifuge rotor of claim 32 wherein the textile structure takes the form of a braid.

43. The centrifuge rotor of claim 42 wherein the braid is defined by a plurality of cords each extending substantially radially across the hub in generally parallel relationship with the other cords, the radially outer ends of the cords being braided together to define the socket.

44. The centrifuge rotor of claim 43 wherein the socket also includes a helper yarn braided with cords.

45. The centrifuge rotor of claim 42 wherein the force transmitting arrangement comprises a saddle having grooves therein; and wherein the braid is defined by a cord which loops around the grooves in the saddle.

46. The centrifuge rotor of claim 45 wherein the cord is terminated by an eyelet which is received in one of the grooves in the saddle.

47. The centrifuge rotor of claim 46 wherein the eyelet is defined by an eye splice.

48. The centrifuge rotor of claim 32 further a second carrier disposed in an overlying layered relationship with respect to the first carrier.

49. A swinging bucket centrifuge rotor for exposing a sample to a centrifugal force field comprising:

a central hub connectable to a source of motive energy for rotating the hub about an axis of rotation;

a sample carrier connectable to the hub, the carrier itself comprising: a woven belt of a high tensile strength fibers formed into a loop centered on the hub to define a first and a second lobe at each radial end of the carrier; a footing having an exterior surface configured for close fitting receipt within each lobe; and a vessel removably mounted to each footing, each vessel being adapted to receive a sample therein;

the sample carrier having flexibly deformable regions disposed intermediate the hub and the radially outer ends of each lobe, the carrier being adapted to accommodate by flexible deformation movement of the vessel in response to centrifugal force from a first, rest, position in which the axis of the vessel is substantially parallel to the axis of rotation to a second, operational, position in which the axis of the vessel is substantially perpendicular to the axis of rotation.

50. The centrifuge rotor of claim 49 wherein the belt is woven with the majority of the fibers thereof extending longitudinally of the belt.

51. The swinging bucket rotor of claim 50 wherein the vessel is movable with respect to the footing along an interface defined therebetween.

52. A swinging bucket centrifuge rotor for exposing a sample to a centrifugal force field comprising:

a hub connectable to a source of motive energy for rotating the hub about an axis of rotation; and a sample carrier connectable to the hub, the sample carrier comprising a braided cord having an eyelet at each end thereof, each eyelet surrounding a saddle member, the saddle being adapted to receive a vessel therein, the braided cord being looped about the saddle to form a structure having a flexibly deformable region disposed intermediate the hub and the saddle, the carrier being adapted to accommodate by flexible deformation movement of the vessel in response to centrifugal force from a first, rest, position in which the axis of the vessel is substantially parallel to the axis of rotation to a second, operational, position in which the axis of the vessel is substantially perpendicular to the axis of rotation.

53. The centrifuge rotor of claim 52 wherein each eyelet is defined by an eye splice.

54. A swinging bucket centrifuge rotor for exposing a sample to a centrifugal force field comprising:

a hub connectable to a source of motive energy for rotating the hub about an axis of rotation;

a sample carrier connectable to the hub, the carrier comprising a plurality of cords each extending substantially radially across the hub in a generally parallel relationship with the other cords, the radially outer ends of the cords being braided together to define a socket adapted to receive a sample therein;

the carrier having a flexibly deformable region intermediate the hub and the socket, the carrier being adapted to accommodate by flexible deformation movement from a first, rest, position in which the axis of the radially outer portion of the carrier is substantially parallel to the axis of rotation to a second, operational, position in which the axis of the radially outer portion of the carrier is substantially perpendicular to the axis of rotation.

55. The centrifuge rotor of claim 54 wherein the free ends of the cords radially outwardly of the socket are consolidated together.

56. The centrifuge rotor of claim 54 wherein the free ends of the cords are braided back into the socket.

57. A swinging bucket centrifuge rotor for exposing a sample to a centrifugal force field comprising:

a hub connectable to a source of motive energy for rotating the hub about an axis of rotation; and a sample carrier connectable to the hub, the sample carrier comprising a central web portion having a plurality of sockets radiating therefrom, a flexibly deformable region being defined intermediate the web and each socket;

the carrier being adapted to accommodate, by flexible deformation movement of the socket from a first, rest, position in which the axis of the socket is substantially parallel to the axis of rotation to a second, operational, position in which the axis of the socket is substantially perpendicular to the axis of rotation.

* * * * *